US009453359B2

(12) United States Patent
Kempf et al.

(10) Patent No.: US 9,453,359 B2
(45) Date of Patent: Sep. 27, 2016

(54) TRUSS HINGE WITH ANGULAR VARIABILITY

(71) Applicant: Production Resource Group, LLC, New Windsor, NY (US)

(72) Inventors: James Kempf, Wallkill, NY (US); Scott Gross, Atlanta, GA (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 14/274,963

(22) Filed: May 12, 2014

(65) Prior Publication Data

US 2014/0360125 A1 Dec. 11, 2014

Related U.S. Application Data

(63) Continuation of application No. 13/098,410, filed on Apr. 30, 2011, now Pat. No. 8,720,152.

(60) Provisional application No. 61/329,842, filed on Apr. 30, 2010.

(51) Int. Cl.

| | |
|---|---|
| ***E04B 1/344*** | (2006.01) |
| ***E05D 7/00*** | (2006.01) |
| ***E04B 1/24*** | (2006.01) |
| ***E04B 1/343*** | (2006.01) |
| ***E04C 3/00*** | (2006.01) |
| ***E04C 3/02*** | (2006.01) |
| *E04C 3/04* | (2006.01) |

(52) U.S. Cl.

CPC ..... *E05D 7/0009* (2013.01); *E04B 1/2403* (2013.01); *E04B 1/344* (2013.01); *E04B 1/34336* (2013.01); *E04C 3/005* (2013.01); *E04C 3/02* (2013.01); *E04C 2003/0491* (2013.01); *Y10T 16/52* (2015.01)

(58) Field of Classification Search

CPC ... E04B 1/344; E04B 1/2403; E04B 1/34336
USPC ..... 52/167.1, 167.3, 641, 643, 645, 646, 52/649.5, 745.14; 14/14
See application file for complete search history.

(56) References Cited

U.S. PATENT DOCUMENTS

| | | | | |
|---|---|---|---|---|
| 5,711,131 | A | 1/1998 | Thomas | |
| 2009/0173033 | A1* | 7/2009 | Baxter, Jr. ..... | A63J 1/00 52/646 |

* cited by examiner

*Primary Examiner* — William Gilbert
(74) *Attorney, Agent, or Firm* — Law Office of Scott C Harris, Inc

(57) ABSTRACT

A truss hinge that allows hinging between truss parts, and also allows configuration into a different size.

5 Claims, 9 Drawing Sheets

TRUSS HINGE WITH ANGULAR VARIABILITY

This application is a continuation application of Ser. No. 13/098,410 filed Apr. 30, 2011, now U.S Pat. No. 8,720,152 issued May 15, 2014, which claims priority from provisional application number 61/329,842, filed Apr. 30, 2010, the entire contents of which are herewith incorporated by reference.

BACKGROUND

Trusses are often used in stage lighting applications to hold stage lights and other items as supports relative to the stage, e.g., above the stage level as supported from a supporting beam above a stage or other object of lighting. Two pieces of truss may be connected together to form longer overall trusses.

SUMMARY

An embodiment describes a truss hinge that connects to truss parts, and allows hinging between different parts.

According to one embodiment, the hinge allowsmovement of the two hinge parts in two opposite directions.

DETAILED DESCRIPTION

The truss hinges used herein have hinged connection parts between the trusses. The trusses are each attached to one side of the hinge. The hinge can move between different angles and in different directions, thereby hinging the truss pieces at different angles between one another.

In an embodiment shown in FIGS. 1A-1E, a number of truss parts 100, 110, 120 are connected together by truss hinges 105 according to an embodiment, to form a connected truss assembly. The different truss parts can be configured to have different angles between them using the truss hinge 105.

Figure 1A:
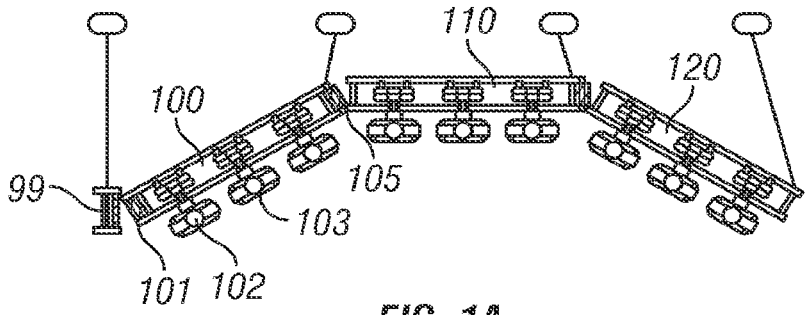
FIGS. 1A-1E show exemplary truss configurations using the truss hinge according to an embodiment.

FIGS. 1A-1E show the different ways in which the different truss parts can be connected. FIG. 1A shows three truss parts 100, 110, 120. The truss part 100 is an end piece and is connected to a typical truss hub 99 via the truss end piece 101. The truss parts have hanging items such as 101, 102, 103 supported therefrom. The hanging items can be moving lights or winches, or any other device that can be supported from a truss for use in a theatrical production, for example. These hinges can use adjustable spreaders that fit the PRG 15×24 and 15×30 BAT truss™ for concert touring lighting. Note in FIG. 1B, truss 100 and 110 have a first direction hinging between them, and truss 110 and 120 have a second direction hinging between them. The first direction and second direction are opposite directions.

Each truss such as 100 can be hinged by a hinging connection such as 105 relative to each truss piece to which it is attached. In the embodiment, each truss piece may have spigots at its end part. The hinging connection connects between spigots of the two truss parts 100, 110, to connect one spigot of one truss part to another spigot of another truss part via the hinge connection 105.

Figure 2:
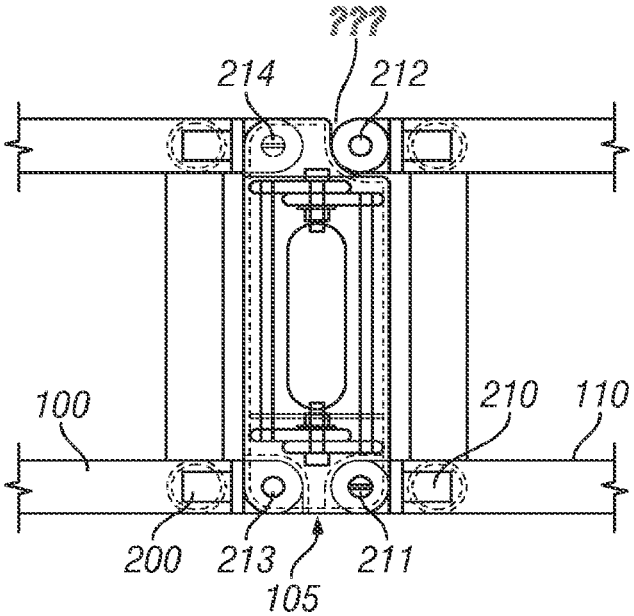
FIG. 2 shows a close-up of the different parts forming the hinging part of the truss hinge.

FIG. 2 illustrates a detail of the connection between the different truss parts. The first truss part 100 has its end adjacent area 105 with a female spigot 200. The second truss part 110 has its end adjacent area 105 with a male spigot 210. The hinge device 105 connects the two spigots to one another, and also allows disconnection relative to one another to allow the two parts to hinge relative to one another. For example, to allow the hinge to rotate downward (in the perspective of FIG. 2), the system as shown in FIG. 2 is configured with no retaining pin in the male spigot location 212, but does have a pin 211 in the connection area near spigot 210. This allows the top parts of the trusses to freely rotate on the pin 211 adjacent the male spigot 210. The area 213 may also be configured with no pin, thereby allowing hinging on the oppositely placed pin 214.

The pins such as 215 may be ¾ inch cotter pins, for example.

According to one embodiment, the hinge can itself have left and right portions, with the left portion in FIG. 2 connected to the truss 100, and the right portion configured to connect to the truss 110. The left portion and right portions can be connected to one another, or can be hinged relative to one another.

Figure 3:
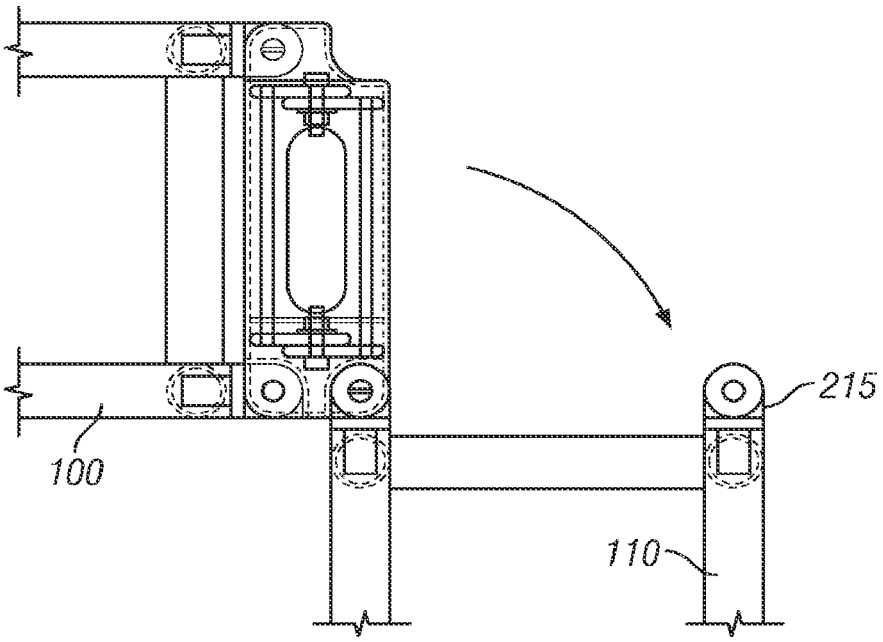
FIG. 3 shows the truss hinge in a 90° rotated down configuration.

FIG. 3 shows how the part 110 can rotate down relative to the part 100, because there is no pin holding the male spigot 215. This may allow the hinging in the first direction.

Figure 4:
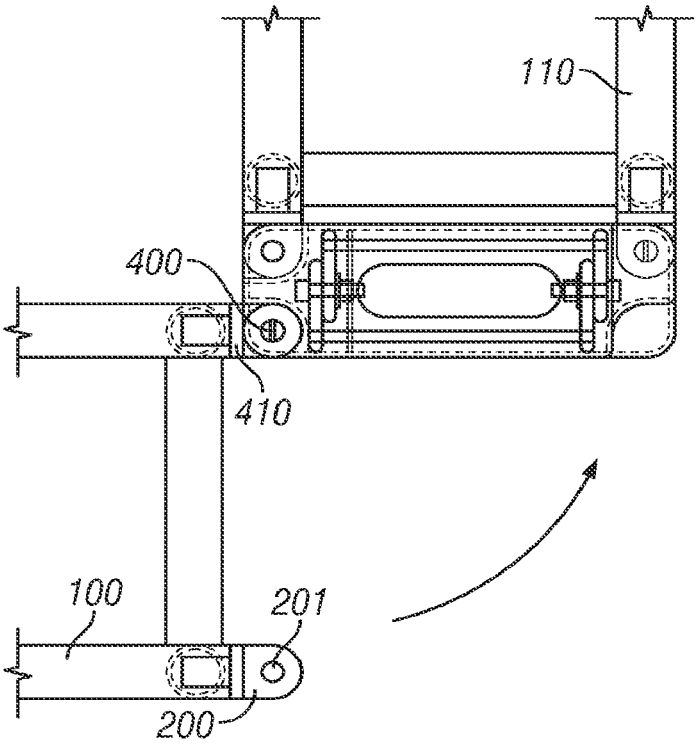
FIG. 4 shows the truss and hinge in a 90° rotated up configuration.

FIG. 4 shows how the spigot 200 may also be formed with no pin in the hole 201 the side of the hinge that is opened by the pivoting. A pin 400 forms a rotational part that holds to the spigot 410. This allows the part 110 to pivot "up", thus hinging in the second direction, opposite to the first direction. Thus, the same hinge allows pivoting in two opposite directions. The opposite directions are opposite angular directions, in the sense that the angle may get "larger" in the first direction, and may get "smaller" in the second direction, or vice versa.

More generally, the hinge assembly allowing the hinging on the pinned spigot holes, relative to the non-pinned spigot holes.

Figure 1B:
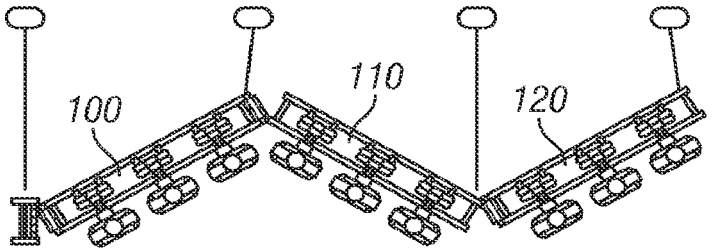
Figure 1C:
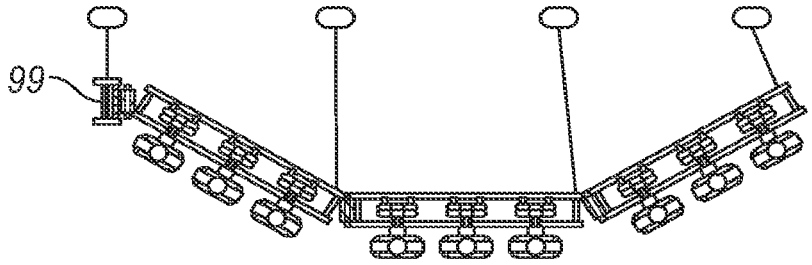
Figure 1D:
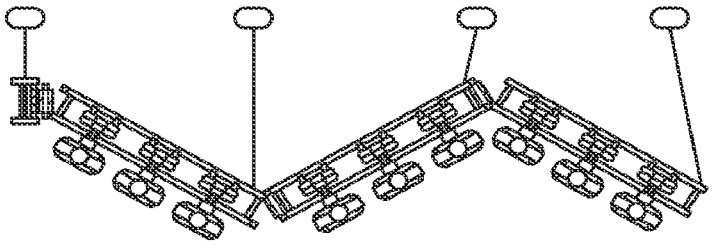
Figure 1E:
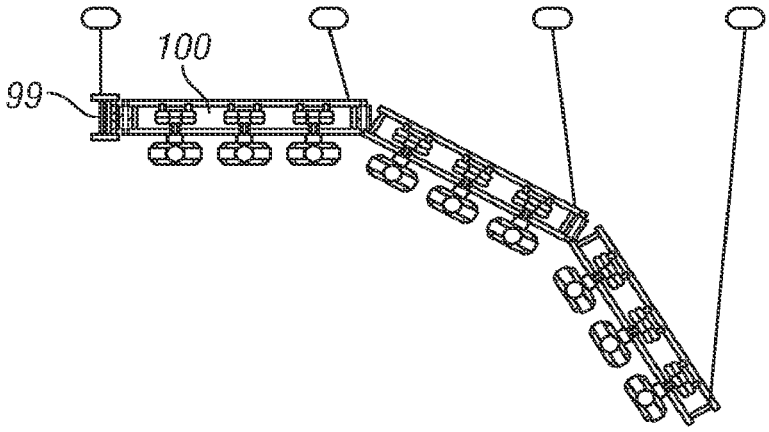

FIGS. 1A-1E show different configurations that can be obtained from the trusses with these hinges. FIG. 1A and 1B show alternate views of zigzag configurations. FIGS. 1A and 1B shows how the end piece 101 may be hinged relative to the hub 99, and how each piece such as 100 may be hinged relative to another piece. FIGS. 1C and 1D shows how the end piece may be completely oppositely hinged relative to the hub piece 99. FIG. 1E shows how the first piece 100 may be connected flat to the hub 99. In the embodiment, the different pieces can be hinged differently relative to the hub and relative to one another. All of these use the same truss hinge.

Figure 5A:
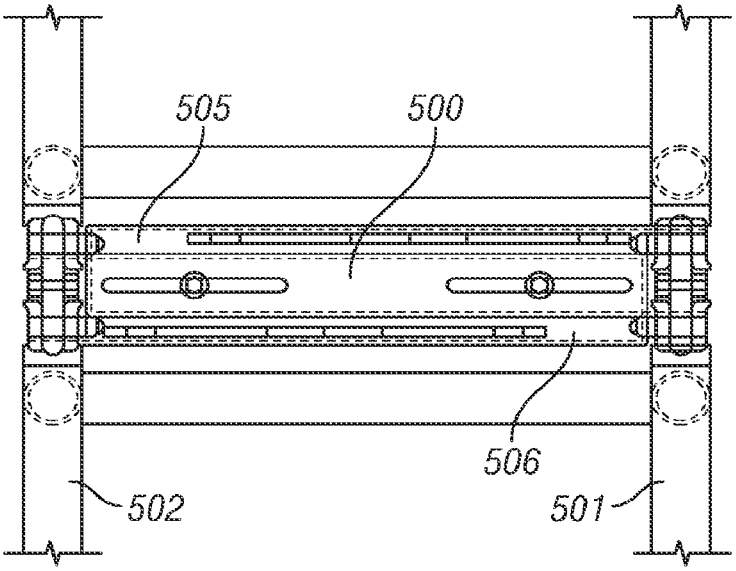
FIG. 5A and 5B show the spreader bars that provide the truss hinge with different configurability.
Figure 5B:
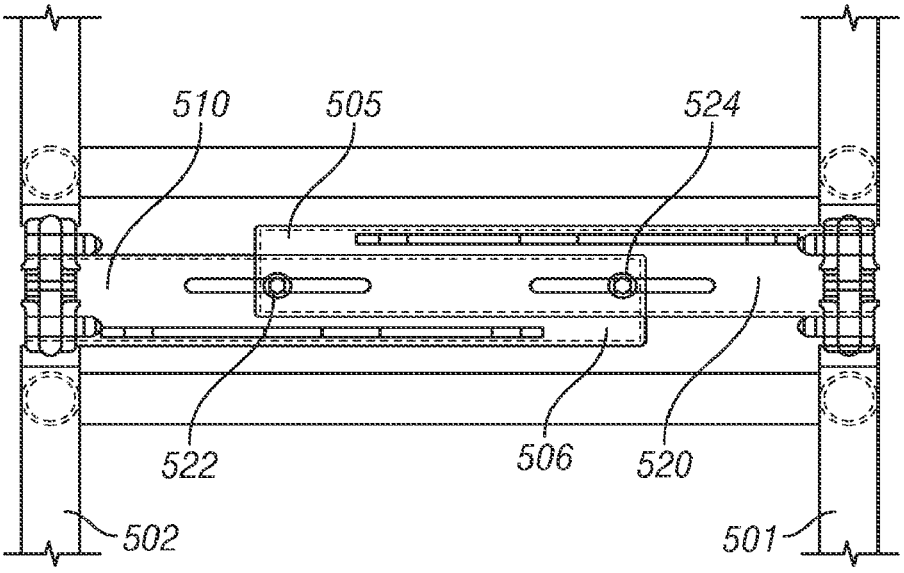

According to an embodiment, the hinges also allow connection to different size trusses by adjustment of the hinge size. FIG. 5A shows a 15×24 truss length configuration, while a 15×30 truss is shown in FIG. 5B. A special adjustment plate 500 is located between the truss parts 501, 502. The adjustment plate has two partly overlapping plates 505 and 506. When the adjustment plate 500 is in the position shown in FIG. 5A, its two plates 505, 506 are completely overlapping in length, causing the minimum length between their edges. Here, each plate 505, 506 is 24 inches long, and this causes the truss to be contracted to a 24 inch size between the truss bar 501 and the opposite truss bar 502.

When the adjustment plate 500 is in its extended position as in FIG. 5B, the two plates 505, 506 only partly overlap leaving areas 510 and 520 extending and not overlapping. The areas 510 and 520 are each 3 inches long. This forms parts of the spreader bar that do not overlap completely with one another and increase the distance between bars 501 and 502 by 3 inches each, for a total of 6 inches, to form a 30 inch spread.

The two plates 505, 506 of the spreader are screwed together at 522, 524.

Figure 6:
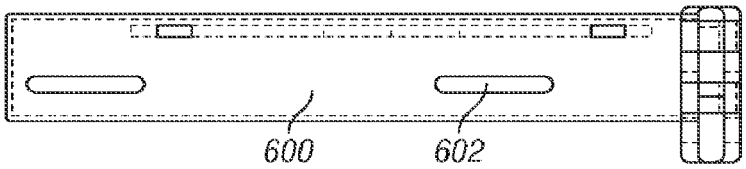
FIGS. 6-9 shows the different parts that make up the right side hinge half.

FIG. 6 illustrates the different parts making up the hinge assembly according to the embodiments. For example, element 600 may form the spreader plates 505, 506 that is connected to the other spreader plate. The spreader plate includes a long slotted portion 602 which enable screwing to another corresponding plate.

Figure 7:
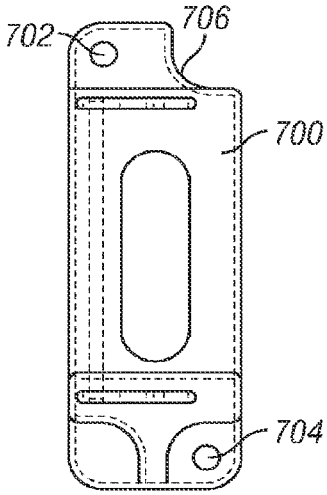
Figure 8:
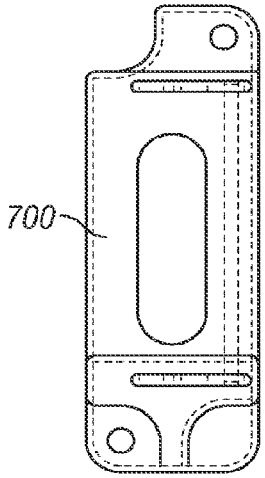

FIGS. 7 and 8 illustrate details of the left and right hinged pieces. The left side view shown in FIG. 7 shows the hinge part 700, with its hinging holes 702 and 704. Note that there are no holes in the area 706, allowing free hinging in those areas. The first and second parts respectively shown in FIGS. 7 and 8 are shaped to be mirror images of one another. Taking FIG. 7 as representative, it can be seen that each of the parts in essence is a rectangle with rounded corners. Two of those corners near 702 and 704 are extending corners, and the other two of the corners, such as near 706, are indented rounded corners. The two corners 702 and 706 with tens therein are opposite one another both in horizontal and vertical directions. The other two corners are free and unpinned portions in opposite corners from said first and second corners.

Figure 9:
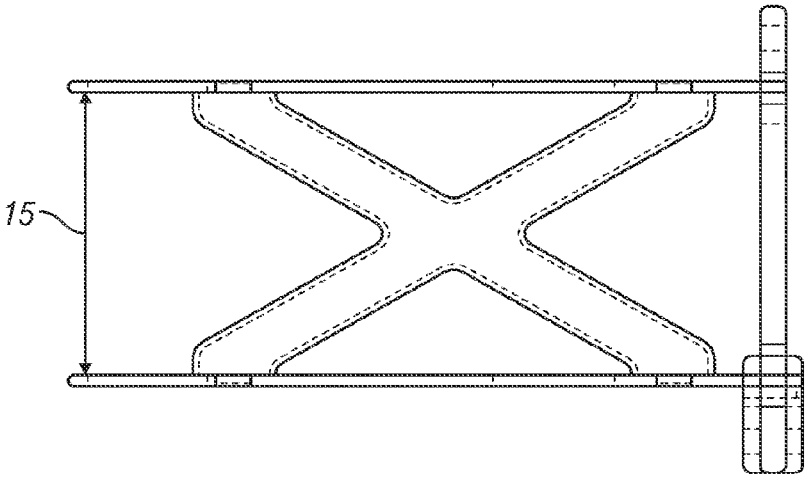
Figure 13A:
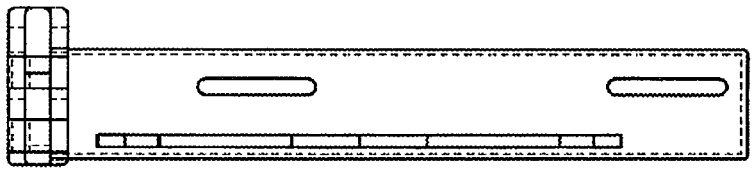
FIG. 10 and FIGS. 13A-13C show the different parts that make up the left side hinge half.
Figure 13B:
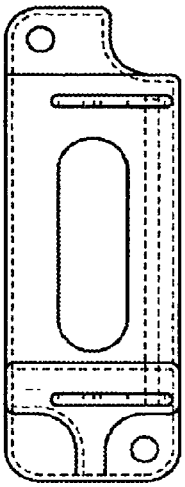
Figure 13C:
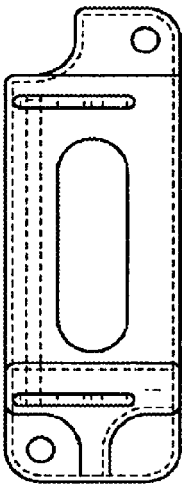
Figure 10:
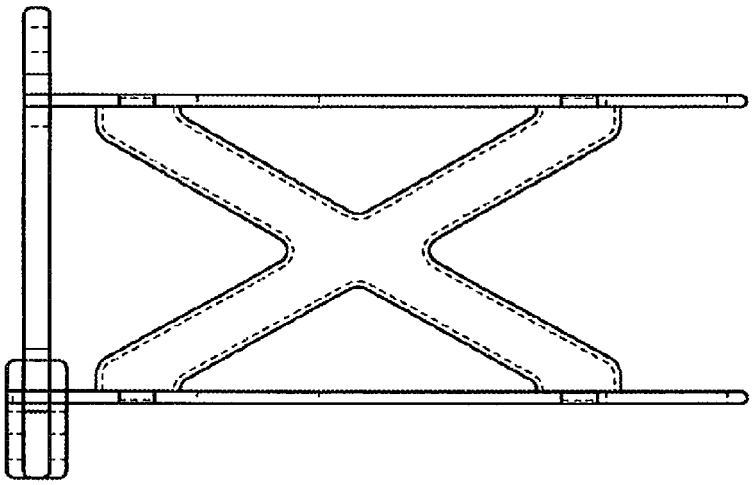

FIG. 9 shows a cross piece style support 900 across the 15 inch portion of the cross pieces between the top and bottom of the truss.

Figure 11:
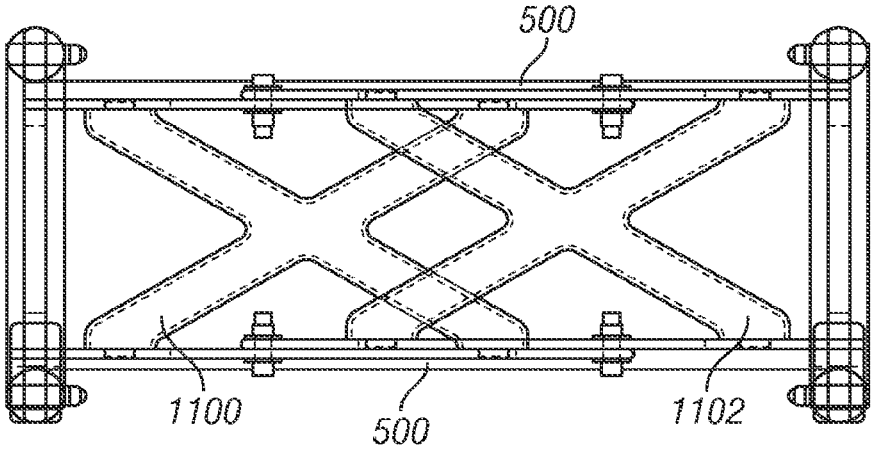
FIGS. 11 and 12 show a side view of respectively expanded and contracted spreaders.
Figure 12:
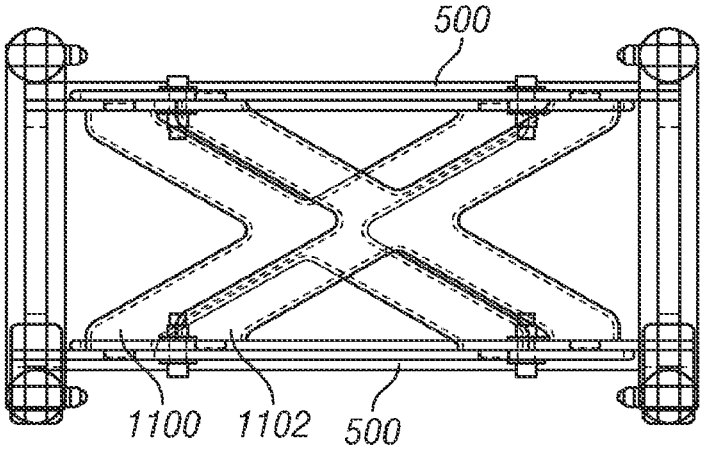
Figure 14A:
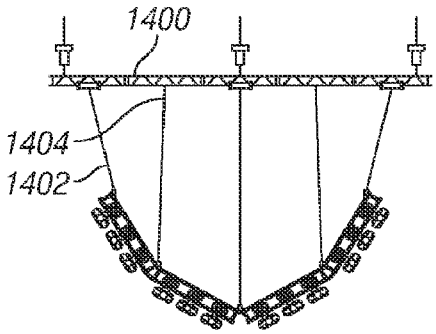
FIG. 14A-14F and 15A-15F show different hanging configurations for the hinged trusses and their parts.
Figure 14B:
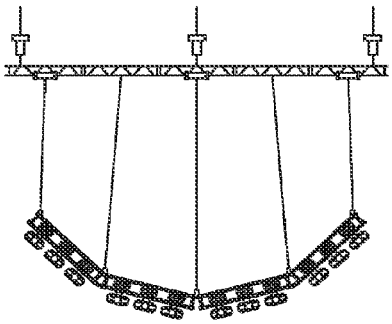
Figure 14C:
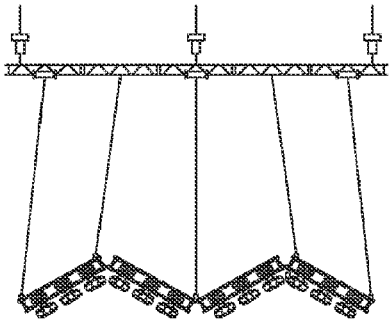
Figure 14D:
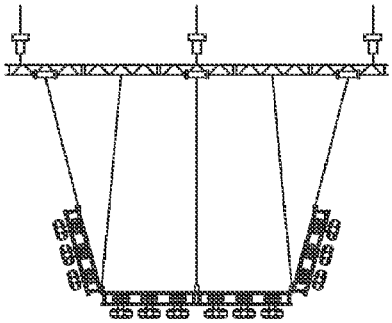
Figure 14E:
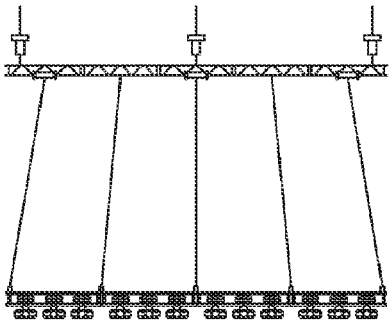
Figure 14F:
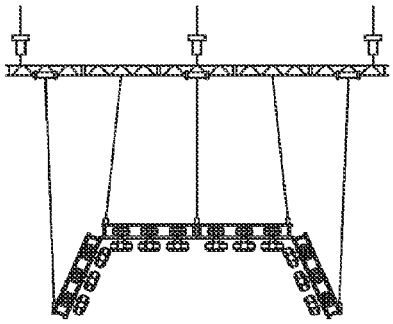
Figure 15A:
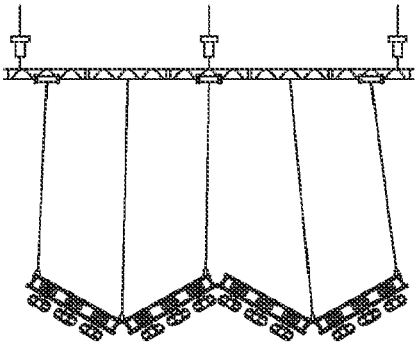
Figure 15B:
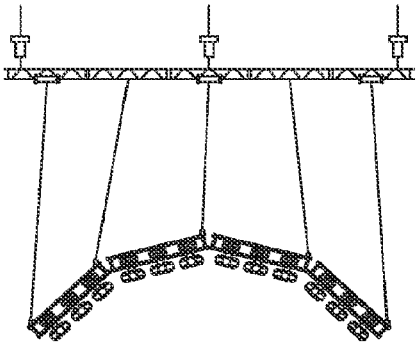
Figure 15C:
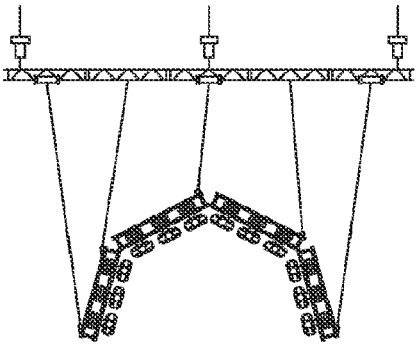
Figure 15D:
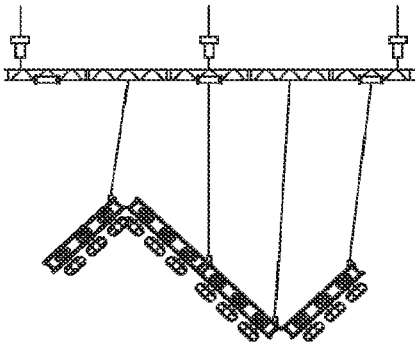
Figure 15E:
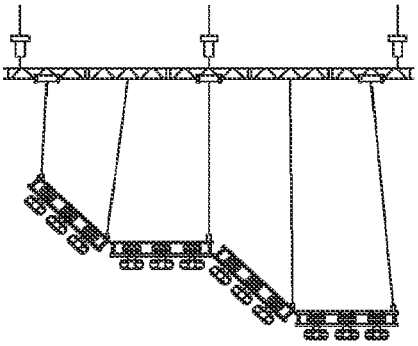
Figure 15F:
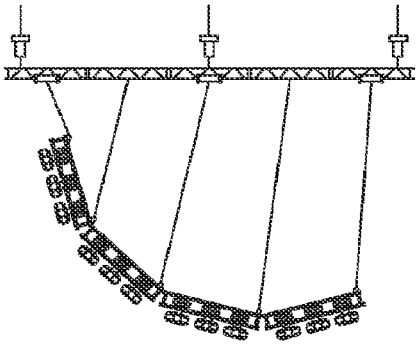

As described above, the hinge can be used on either a 15×30 truss or a 15×24 non-extended position using the spreaders 500. The spreaders 500 in their extended position are shown in FIG. 11, where the truss is extended into its extended form. In this position, the two cross shaped areas 1100, 1102 are offset from one another. When the plates are moved to their fully overlapped position as shown in FIG. 5A, the truss is in the position shown in FIG. 12, where the two cross shaped portions 1100 and 1102 mostly overlap in position.

The left hinge half is mirrored from the right hinge half, shown in FIGS. 10 and 13A-13C.

FIG. 14 shows another embodiment, where the connections to the truss ends and other parts that are not connected to a fixed hub at least at one end. In FIG. 14, the main support 1400 is shown, and the main support has a number of cables connected. The cables 1402, 1404 are each connected to hold a truss piece, with one cable at each end. FIG. 14 shows a first truss connection set, and FIG. 15 shows a second truss connection set. The cables can be connected, for example, to at least one of the first and second parts forming the hinges.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example other shapes besides the ones shown in the figures can be formed.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of hinging trusses, comprising:

connecting both first and second ends of a first truss to a first connection part of a hinging connection device via first connections that connect to both first and second ends of said first truss;

connecting both first and second ends of a second truss to a second connection part of said hinging connection device via second connections that connect to first and second ends of said second truss;

using an adjustment plate on said hinging connection device for adjusting a distance between said first connections on said first part and said second connections on said second part, where a first distance between said first connections on said first part and said second connections on said second part accommodates first trusses that are a first size, and a second distance between said first connections on said first part and said second connections on said second part accommodates second trusses that are a second size different than the first size; and said hinging connection device hinging between said first part and said second part to thereby adjust an angle between said first truss and said second truss.

2. A method as in claim 1, wherein said hinging comprises, after connecting the first truss and the second truss, first pivoting in a first direction between said first truss and said second truss using said hinging connection device, and second, while said first truss and said second truss are still connected, hinging in a second direction opposite to said first direction using the same hinging connection device.

3. A method as in claim 1, wherein said first part and said second connection parts are shaped to be mirror images of one another.

4. A method as in claim 1, wherein said first and second connections include spigots that connect directly to surfaces of the trusses.

5. A method as in claim 1, further comprising hanging said trusses from cables that are attached to at least one of said first part or said second part.

* * * * *